US010626538B2

(12) United States Patent
Dunn

(10) Patent No.: US 10,626,538 B2
(45) Date of Patent: Apr. 21, 2020

(54) WASHING MACHINE APPLIANCE AND METHODS OF OPERATION

(71) Applicant: Haier US Appliance Solutions, Inc., Wilmington, DE (US)

(72) Inventor: David Scott Dunn, Smithfield, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 289 days.

(21) Appl. No.: 15/629,818

(22) Filed: Jun. 22, 2017

(65) Prior Publication Data

US 2018/0371673 A1 Dec. 27, 2018

(51) Int. Cl.

| | |
|---|---|
| ***D06F 37/20*** | (2006.01) |
| ***D06F 39/00*** | (2020.01) |
| ***D06F 21/12*** | (2006.01) |
| ***D06F 23/04*** | (2006.01) |
| ***D06F 33/02*** | (2006.01) |
| *D06F 35/00* | (2006.01) |
| *D06F 37/24* | (2006.01) |

(52) U.S. Cl.

CPC ..... *D06F 39/006* (2013.01); *D06F 21/12* (2013.01); *D06F 23/04* (2013.01); *D06F 33/02* (2013.01); *D06F 39/005* (2013.01); *D06F 35/00* (2013.01); *D06F 37/24* (2013.01); *D06F 37/245* (2013.01); *D06F 2202/12* (2013.01); *D06F 2212/02* (2013.01); *D06F 2216/00* (2013.01)

(58) Field of Classification Search

CPC ..... D06F 37/203; D06F 37/225; D06F 37/245
See application file for complete search history.

(56) References Cited

U.S. PATENT DOCUMENTS

| | | | | |
|---|---|---|---|---|
| 4,254,849 | A * | 3/1981 | Pohlenz | D06F 37/20 137/38 |
| 5,257,680 | A | 11/1993 | Corcoran et al. | |
| 7,861,833 | B2 | 1/2011 | Park et al. | |
| 8,984,693 | B2 | 3/2015 | Ashrafzadeh et al. | |
| 9,359,705 | B2 | 6/2016 | Nishimura et al. | |
| 2004/0148980 | A1 | 8/2004 | Kim et al. | |

(Continued)

FOREIGN PATENT DOCUMENTS

| | | | | |
|---|---|---|---|---|
| DE | 102008039569 | A1 * | 3/2010 | D06F 37/203 |
| EP | 1243686 | A1 * | 9/2002 | D06F 37/20 |
| WO | WO-2015085791 | A1 * | 6/2015 | |

OTHER PUBLICATIONS

DE102008039569—Machine Translation (Year: 2010).*

*Primary Examiner* — Marc Lorenzi
(74) *Attorney, Agent, or Firm* — Dority & Manning, P.A.

(57) ABSTRACT

A washing machine appliance and methods of operation are provided. The washing machine appliance generally includes an apron and a sub-washer unit suspended within the apron by a plurality of dampers. A measurement device is mounted on the sub-washer unit to measure the movement of the sub-washer unit. The movement of each damper is calculated based on the relative position of the damper and the measurement device. By monitoring the movement of each damper, the amount of energy dissipated by each damper during operation may be calculated and the operation of the washing machine appliance may be adjusted when the amount of energy dissipated and/or power level exceeds a predetermined energy threshold.

11 Claims, 5 Drawing Sheets

(56) References Cited

U.S. PATENT DOCUMENTS

| | | | | |
|---|---|---|---|---|
| 2007/0283511 | A1* | 12/2007 | Pelczer | D06F 33/02 8/158 |
| 2009/0266113 | A1 | 10/2009 | Musser et al. | |
| 2009/0288260 | A1* | 11/2009 | Jurmann | D06F 37/203 8/159 |
| 2013/0340485 | A1 | 12/2013 | Zeh | |
| 2015/0020550 | A1* | 1/2015 | Yu | D06F 37/24 68/23.2 |
| 2016/0215437 | A1* | 7/2016 | Jackson | D06F 37/20 |
| 2016/0312394 | A1* | 10/2016 | Wang | D06F 37/22 |
| 2018/0080162 | A1* | 3/2018 | Hoppe | D06F 37/268 |

* cited by examiner

WASHING MACHINE APPLIANCE AND METHODS OF OPERATION

FIELD OF THE INVENTION

The present subject matter relates generally to washing machine appliances and, more particularly, to suspension systems and methods of limiting energy dissipated in such systems.

BACKGROUND OF THE INVENTION

Washing machine appliances typically include an apron and a sub-washer unit. The sub-washer unit includes a wash basket rotatably mounted within a wash tub, the wash basket defining a wash chamber for receipt of clothing articles. Washing machine appliances utilize wash and rinse fluids to clean clothing articles within the wash chamber. More specifically, a motor assembly is coupled to the wash tub and configured to rotate the wash basket within the wash tub in order to cleanse articles within the wash basket. Upon completion of a wash cycle, a pump assembly can be used to rinse and drain soiled water to a draining system.

When the wash basket is rotating, out of balance loads can cause the sub-washer unit to translate relative to its center position and wobble relative to its axis of rotation. In certain conventional washing machine appliances, the sub-washer unit is preferably mounted within the apron by suspending the sub-washer unit using a suspension system attached to the apron. More specifically, typical suspension systems include a plurality of dampers that extend between the sub-washer unit and fixed corner brackets mounted to the apron. The dampers are intended to maintain sub-washer unit in the neutral position and absorb forces and movement resulting from load imbalances to prevent them from transferring directly to the supporting floor, e.g., through the apron.

However, large movements and oscillations experienced by the dampers can result in large cyclic stresses and excessive heating on the dampers. These stresses and excess heat can result in premature wear and failure of the dampers or other components of the washing machine appliance. Accordingly, a washing machine appliance with features for limiting component stresses resulting from load imbalances would be useful. More specifically, a washing machine appliance and methods of operation which limit the heat and cyclic stresses experienced by the suspension system would be particularly beneficial.

BRIEF DESCRIPTION OF THE INVENTION

The present subject matter provides a washing machine appliance and methods of operation. The washing machine appliance generally includes an apron and a sub-washer unit suspended within the apron by a plurality of dampers. A measurement device is mounted on the sub-washer unit to measure the movement of the sub-washer unit. The movement of each damper is calculated based on the relative position of the damper and the measurement device. By monitoring the movement of each damper, the amount of energy dissipated by each damper during operation may be calculated and the operation of the washing machine appliance may be adjusted when the amount of energy dissipated and/or power level exceeds a predetermined energy threshold. Additional aspects and advantages of the invention will be set forth in part in the following description, or may be apparent from the description, or may be learned through practice of the invention.

In one exemplary embodiment of the present disclosure, a washing machine appliance is provided including an apron defining a vertical direction, a lateral direction, and a transverse direction, the vertical, lateral, and transverse directions being mutually orthogonal. A sub-washer unit is positioned within the apron, the sub-washer unit including a wash basket defining a wash chamber for receipt of articles for washing and being rotatable about an axis of rotation. A motor assembly is operably coupled with the wash basket for rotating the wash basket and a suspension system includes a plurality of dampers extending between the apron and the sub-washer unit for suspending the sub-washer unit within the apron. A measurement device is mounted to the sub-washer unit and a controller is in operative communication with the motor assembly and the measurement device. The controller is configured for monitoring a movement of the sub-washer unit using the measurement device and calculating an amount of energy dissipated in at least one of the plurality of dampers as a result of the movement of the sub-washer unit. The controller is further configured for determining that the amount of energy dissipated has exceeded a predetermined energy threshold and adjusting the operation of the washing machine appliance in response to determining that the amount of energy dissipated has exceeded the predetermined energy threshold.

In another exemplary embodiment of the present disclosure, a method for operating a washing machine appliance is provided. The washing machine appliance includes an apron and a sub-washer unit positioned within the apron and suspended by a plurality of dampers. The sub-washer unit includes a wash basket defining a wash chamber for receipt of articles for washing and being rotatable about an axis of rotation, and a measurement device is mounted to the sub-washer unit. The method includes monitoring a movement of the sub-washer unit using the measurement device and calculating an amount of energy dissipated in at least one of the plurality of dampers as a result of the movement of the sub-washer unit. The method further includes determining that the amount of energy dissipated has exceeded a predetermined energy threshold and adjusting the operation of the washing machine appliance in response to determining that the amount of energy dissipated has exceeded the predetermined energy threshold.

According to still another exemplary embodiment of the present disclosure, a washing machine appliance is provided including an apron defining a vertical direction, a lateral direction, and a transverse direction, the vertical, lateral, and transverse directions being mutually orthogonal. A sub-washer unit is positioned within the apron, the sub-washer unit including a wash basket defining a wash chamber for receipt of articles for washing and being rotatable about an axis of rotation. A motor assembly is operably coupled with the wash basket for rotating the wash basket and a measurement device is mounted to the sub-washer unit. A controller is in operative communication with the motor assembly and the measurement device, the controller being configured for measuring an acceleration of the sub-washer unit using the measurement device and calculating a displacement of the sub-washer unit at a location remote from the measurement device. The controller is further configured for calculating an amount of cyclic stress at the location remote from the measurement device based on the calculated displacement, determining that the amount of cyclic stress has exceeded a predetermined cyclic stress threshold, and adjusting the operation of the washing machine appliance in response to determining that the amount of cyclic stress has exceeded the predetermined cyclic stress threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
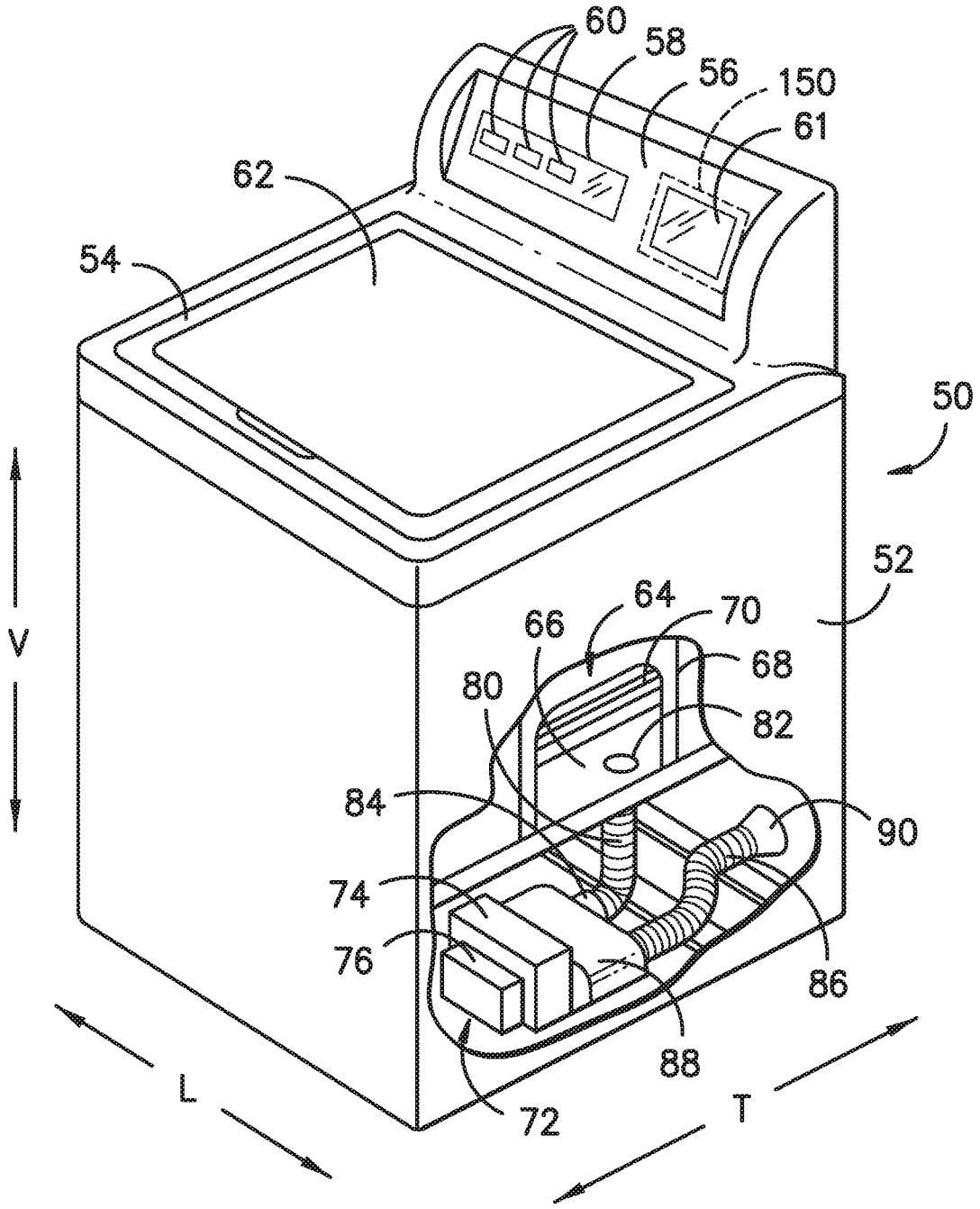
FIG. 1 provides a perspective view of a washing machine appliance according an exemplary embodiment of the present subject matter.

Repeat use of reference characters in the present specification and drawings is intended to represent the same or analogous features or elements of the present invention.

DETAILED DESCRIPTION

Reference will now be made in detail to embodiments of the invention, one or more examples of which are illustrated in the drawings. Each example is provided by way of explanation of the invention, not limitation of the invention. In fact, it will be made apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view partially broken away of a washing machine appliance 50 according to an exemplary embodiment of the present subject matter. As may be seen in FIG. 1, washing machine appliance 50 defines a vertical direction V, a lateral direction L, and a transverse direction T. The vertical direction V, lateral direction L, and transverse direction T are mutually perpendicular and form an orthogonal direction system.

Washing machine appliance 50 includes a cabinet or apron 52 and a top panel or cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment a display 61 indicates selected features, a countdown timer, and other items of interest to machine users. A lid 62 is mounted to cover 54 and is rotatable about a hinge (not shown) between an open position (not shown) facilitating access to a wash tub 64 located within apron 52, and a closed position (shown in FIG. 1) forming a sealed enclosure over wash tub 64.

As illustrated in FIG. 1, washing machine appliance 50 is a vertical axis washing machine appliance such that an axis of rotation of a wash basket (described below) is substantially parallel to the vertical direction V. While the present disclosure is discussed with reference to a vertical axis washing machine appliance, those of ordinary skill in the art, using the disclosures provided herein, should understand that the subject matter of the present disclosure is equally applicable to other washing machine appliances, such as horizontal axis washing machine appliances. In this regard, the axis of rotation of the wash basket could be parallel to the transverse direction T according to alternative embodiments.

A sub-washer unit 65 (see FIG. 2) is mounted within apron 52. Sub-washer unit 65 includes wash tub 64 and a basket 70. Wash tub 64 includes a bottom wall 66 and a sidewall 68, and basket 70 is rotatably mounted within wash tub 64. A pump assembly 72 is located beneath wash tub 64 and basket 70 for gravity assisted flow when draining wash tub 64. Pump assembly 72 includes a pump 74 and a motor 76. A pump inlet hose 80 extends from a wash tub outlet 82 in tub bottom wall 66 to a pump inlet 84, and a pump outlet hose 86 extends from a pump outlet 88 to an appliance washing machine water outlet 90 and ultimately to a building plumbing system discharge line (not shown) in flow communication with outlet 90.

Figure 2:
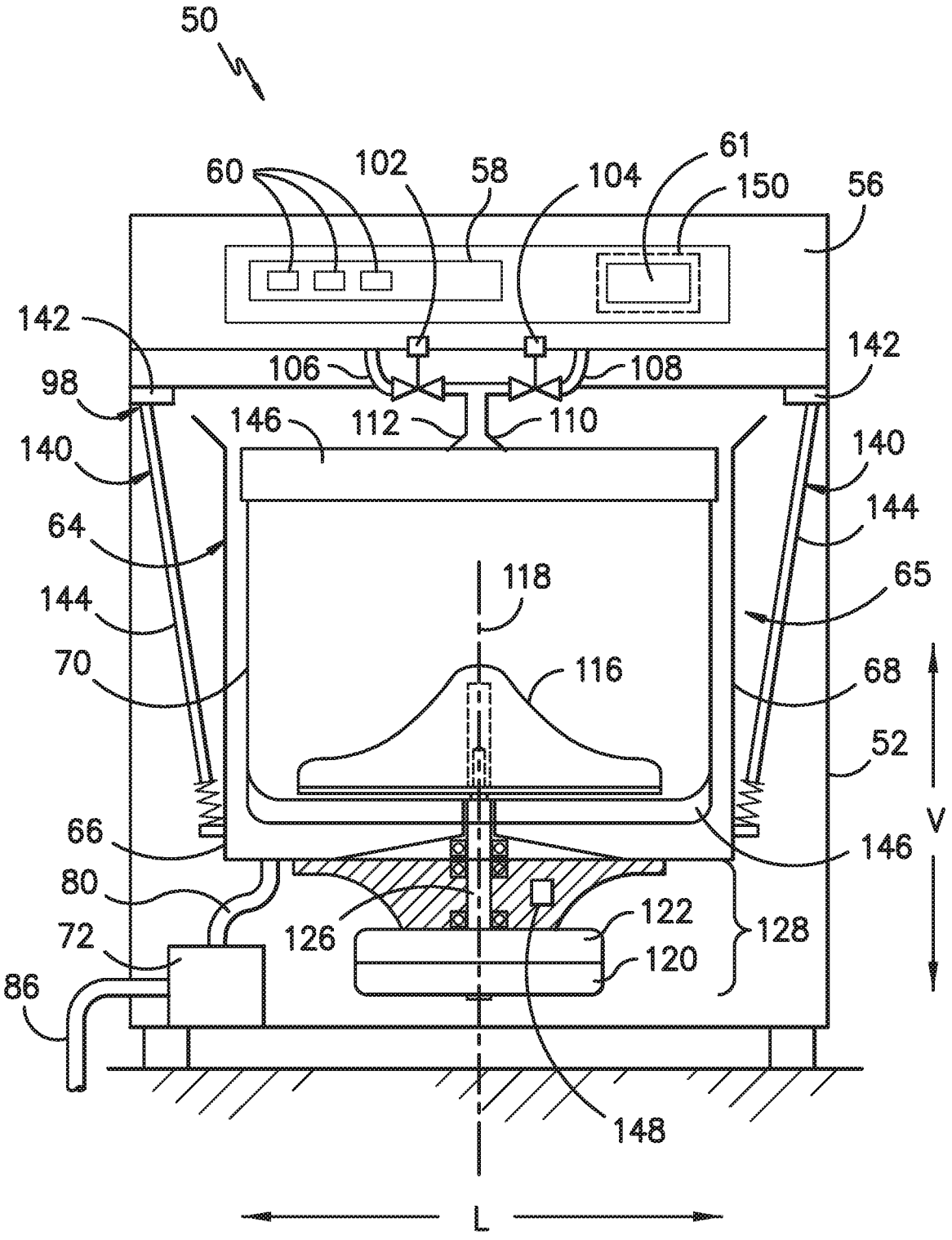
FIG. 2 provides a schematic, front view of the exemplary washing machine appliance of FIG. 1 with the front cover removed to illustrate a suspension system according to an exemplary embodiment of the present subject matter.

FIG. 2 provides a front elevation schematic view of certain components washing machine appliance 50 including wash basket 70 movably disposed and rotatably mounted in wash tub 64 in a spaced apart relationship from tub side wall 68 and tub bottom 66. Basket 70 includes a plurality of perforations therein to facilitate fluid communication between an interior of basket 70 and wash tub 64.

A hot liquid valve 102 and a cold liquid valve 104 deliver fluid, such as water, to basket 70 and wash tub 64 through a respective hot liquid hose 106 and a cold liquid hose 108. Liquid valves 102, 104 and liquid hoses 106, 108 together form a liquid supply connection for washing machine appliance 50 and, when connected to a building plumbing system (not shown), provide a fresh water supply for use in washing machine appliance 50. Liquid valves 102, 104 and liquid hoses 106, 108 are connected to a basket inlet tube 110, and fluid is dispersed from inlet tube 110 through a nozzle assembly 112 having a number of openings therein to direct washing liquid into basket 70 at a given trajectory and velocity. A dispenser (not shown in FIG. 2), may also be provided to produce a wash solution by mixing fresh water with a known detergent or other composition for cleansing of articles in basket 70.

In some embodiments, an agitation element 116, such as a vane agitator, impeller, auger, or oscillatory basket mechanism, or some combination thereof is disposed in basket 70 to impart an oscillatory motion to articles and liquid in basket 70. In various exemplary embodiments, agitation element 116 may be a single action element (oscillatory only), double action (oscillatory movement at one end, single direction rotation at the other end) or triple action (oscillatory movement plus single direction rotation at one end, single direction rotation at the other end). As illustrated in FIG. 2, agitation element 116 is oriented to rotate about an axis of rotation 118.

Basket 70 and agitation element 116 are driven by a motor 120 through a transmission and clutch system 122. The motor 120 drives a drive shaft 126 to rotate basket 70 within wash tub 64. Clutch system 122 facilitates driving engagement of basket 70 and agitation element 116 for rotatable movement within wash tub 64, and clutch system 122 facilitates relative rotation of basket 70 and agitation element 116 for selected portions of wash cycles. Motor 120 and transmission and clutch system 122 collectively are referred herein as a motor assembly 128 and may be a component of sub-washer unit 65.

Figure 3:
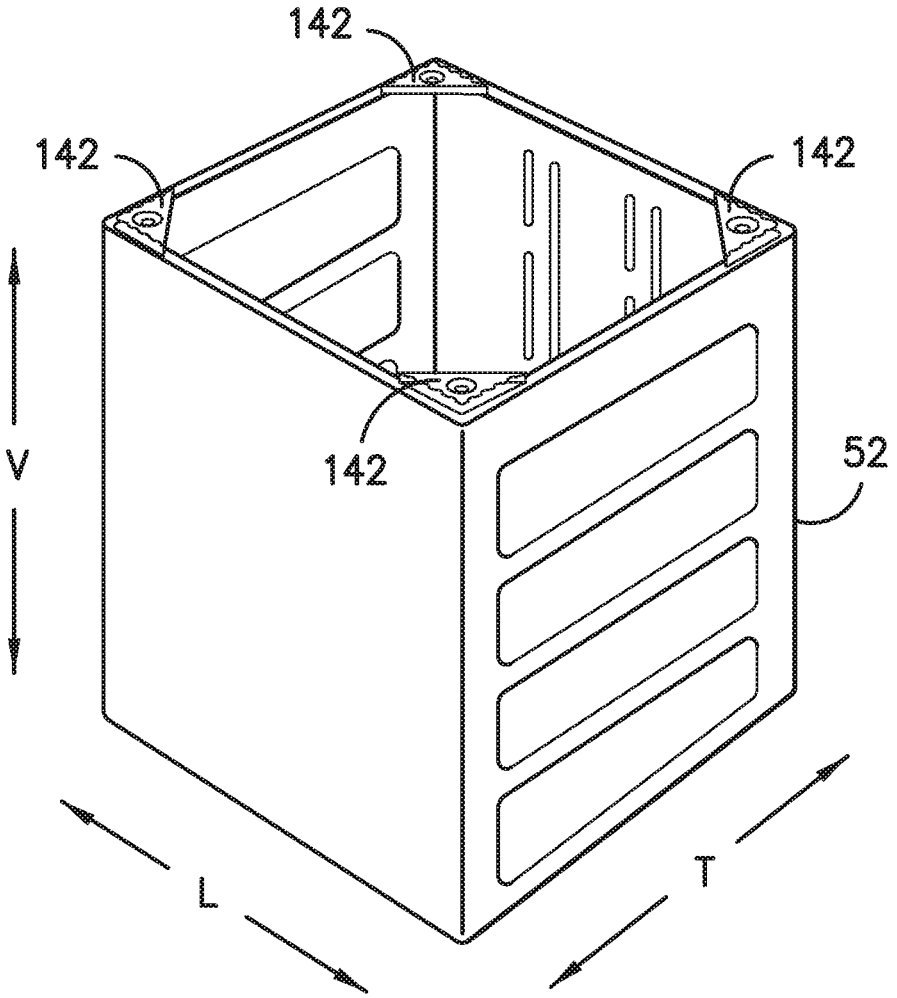
FIG. 3 provides a top, perspective view of certain components of the exemplary washing machine appliance of FIG. 1, including four brackets mounted to an apron.

Sub-washer unit 65 further includes a suspension system 140 which includes of a support rod 160, a spring 172, and a damper or piston assembly 170 (described below) for supporting sub-washer unit 65 within apron 52. One end of suspension system 140 may be connected to sub-washer unit 65 while an opposite end of suspension system 140 is receivable within and/or coupled to at least one bracket 142. For example, as illustrated in FIG. 3, washing machine appliance 50 includes four brackets 142 positioned at each corner of a top of apron 52. Thus, suspension system 140 may extend between sub-washer unit 65 and brackets 142 in order to suspend sub-washer unit 65 within apron 52.

Suspension system 140 can include a plurality of damping elements, such as piston-cylinder damping elements, referred to herein generally as dampers 144 and described in detail below. The dampening suspension system 140 can include other elements, such as a balance ring 146 disposed around the upper circumferential surface of the wash basket 70. The balance ring 146 can be used to counterbalance an out of balance condition for the wash machine as the basket 70 rotates within the wash tub 64. The wash basket 70 could also include a balance ring 146 located at a lower circumferential surface of the wash basket 70.

Referring still to FIG. 2, one or more measurement devices 148 may be provided in the washing machine appliance 50 for measuring movement of sub-washer unit 65, for instance, while basket 70 spins during one or more phases of a wash cycle. As will be described in greater detail below, movement may be monitored as acceleration or displacement values detected from, for instance, one or more measurement devices 148. Measurement devices 148 may measure a variety of suitable variables, which can be correlated to movement of sub-washer unit 65. The movement measured by such devices 148 can be utilized according to exemplary embodiments to calculate the movement of one or more dampers 144.

According to exemplary embodiments, a measurement device 148 in accordance with the present disclosure may include an accelerometer that provides acceleration data that can be used to calculate motion, such as acceleration along one or more directions. More specifically, for example, measurement device 148 may be configured for measuring the acceleration of sub-washer unit 65 along the vertical direction V, the lateral direction L, and the transverse direction T. Additionally or alternatively, a measurement device 148 may include a gyroscope that measures rotational motion, such as rotational velocity about an axis. More specifically, for example, measurement device 148 may be configured for measuring the rotation of the sub-washer unit about the vertical direction V, the lateral direction L, and the transverse direction T. In this manner, measurement device 148 may obtain a complete, six degree of freedom representation of the movement of sub-washer unit 65.

Measurement device 148 may be positioned at any suitable position within washing machine appliance 50 for measuring the movement of sub-washer unit 65 as described herein. For example, a measurement device 148 in accordance with the present disclosure is mounted to the sub-washer unit 65 at a location away from the axis of rotation 118. More specifically, for example, measurement device 148 may be positioned on sub-washer unit 65 at a location halfway between axis of rotation 118 and sidewall 68 of wash tub 64. Other suitable positions for measurement device 148 are possible according to alternative embodiments.

According to exemplary embodiments, acceleration of sub-washer unit 65 may be measured by measurement device 148 continuously or during a predetermined stage, time period, operating cycle, etc. As an example, monitoring or detection of acceleration may be initiated in response to a set cycle or rotation speed. As another example, acceleration values may be gathered continuously during a time period, but only collected or further analyzed during a predetermined stage, e.g., at the set rotation speed.

Operation of washing machine appliance 50 is controlled by a controller 150 that is operatively coupled to the control panel 58 (e.g., inputs 60 and/or display 61) located on washing machine backsplash 56 (shown in FIG. 1) for user manipulation to select washing machine cycles and features. In response to user manipulation of control panel 58, controller 150 operates the various components of washing machine appliance 50 to execute selected machine cycles and features.

Controller 150 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 150 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

Control panel 58 and other components of washing machine appliance 50 may be in communication with controller 150 via one or more signal lines or shared communication busses to provide signals to and/or receive signals from the controller 150. For example, controller 150 may be in operable communication with motor assembly 128, a rotational speed sensor (not shown) on motor assembly 128 to detect rotational velocity of motor 120, measurement device(s) 148, or any other suitable sensors. Optionally, measurement device 148 may be included with controller 150. Moreover, measurement devices 148 may include a microprocessor that performs the calculations specific to the measurement of motion with the calculation results being used by controller 150.

In an illustrative embodiment, laundry items are loaded into basket 70, and washing operation is initiated through operator manipulation of control input selectors 60 (shown in FIG. 1). Wash tub 64 is filled with water and mixed with detergent to form a wash fluid, and basket 70 is agitated with agitation element 116 for cleansing of laundry items in basket 70. That is, agitation element is moved back and forth in an oscillatory back and forth motion about axis of rotation 118, while basket 70 remains generally stationary (i.e., not actively rotated). In the illustrated embodiment, agitation element 116 is rotated clockwise a specified amount about the vertical axis of the machine, and then rotated counter-clockwise by a specified amount. The clockwise/counter-clockwise reciprocating motion is sometimes referred to as a stroke, and the agitation phase of the wash cycle constitutes a number of strokes in sequence. Acceleration and deceleration of agitation element 116 during the strokes imparts mechanical energy to articles in basket 70 for cleansing action. The strokes may be obtained in different embodiments with a reversing motor, a reversible clutch, or other known reciprocating mechanism. After the agitation phase of the wash cycle is completed, wash tub 64 is drained with pump assembly 72. Laundry items are then rinsed and portions of the cycle may be repeated, including the agitation phase, depending on the particulars of the wash cycle selected by a user.

Figure 4:
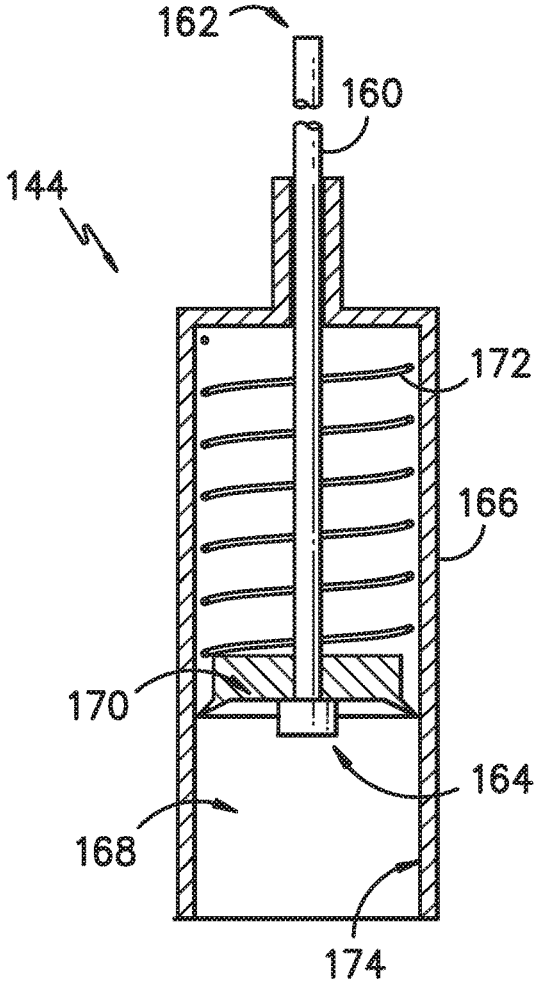
FIG. 4 provides a cross-sectional view of a damper that may be used with the exemplary suspension system of FIG. 2 according to an exemplary embodiment of the present subject matter.

Referring now to FIGS. 2 through 4, suspension system 140 and dampers 144 will be described according to an exemplary embodiment of the present subject matter. Notably, during a spin cycle, wash basket 70 is rotated at relatively high speeds. Such high speed rotation may cause vibration and/or relative movement of the sub-washer unit 65 with respect to apron 52. As such, suspension system 140 is included for supporting sub-washer unit 65 within apron 52 and generally reducing vibration and/or relative movement transferred from sub-washer unit 65 to apron 52. According to the illustrated embodiment, suspension system 140 includes four dampers 144 extending from a top of apron 52 to a bottom of sub-washer unit 65 substantially along the vertical direction V. However, it should be appreciated that a different number, size, type, and configuration of dampers may be used according to alternative embodiments.

FIG. 4 provides section view of damper 144 according to an exemplary embodiment of the present subject matter. Damper 144 may be used in any suitable washing machine appliance. For example, damper 144 may be used in washing machine appliance 50 (FIG. 1) as part of dampening suspension system 140 in order to couple sub-washer unit 65 to apron 52 and dampen motion of sub-washer unit 65 relative to apron 52.

As may be seen in FIG. 4, damper 144 includes a shaft or rod 160. Rod 160 extends, e.g., linearly, between a first end portion 162 and a second end portion 164. First end portion 162 of rod 160 may be, e.g., rotatably or pivotally, mounted or otherwise coupled to apron 52, e.g., via bracket 142. Damper 144 also includes a casing or cylinder 166 positioned at or adjacent second end portion 164 of rod 160. Cylinder 166 may be rotatably or pivotally mounted or fixed to tub 64 of washing machine appliance 50 and defines an interior volume 168. A piston assembly 170 is disposed within interior volume 168 of cylinder 166 and is movable or slidable within cylinder 166. Rod 160 also extends through cylinder 166, e.g., at second end portion 164 and is operably coupled with piston assembly 170.

A spring 172 or other biasing mechanism extends between cylinder 166 and piston assembly 170 within interior volume 168 of cylinder 166. Spring 172 biases or urges piston assembly 170 and rod 160 towards toward an equilibrium position, e.g., by resisting compression relative to the equilibrium position. In addition, spring 172 provides sub-washer unit 65 rocking motion degrees of freedom, supports sub-washer unit 65 within apron 52, and assists with coupling cylinder 166 to rod 160.

Piston assembly 170 may compress gases, such as air, within interior volume 168 of cylinder 166 during motion of sub-washer unit 65 relative to apron 52. In addition, friction between components of piston assembly 170 and an inner surface 174 of cylinder 166 provides damping of the motion of sub-washer unit 65 relative to apron 52 during motion of piston assembly 170 within cylinder 166. It should be appreciated that damper 144 is described herein only for the purpose of explaining aspects of the present subject matter. Alternative damping systems and configurations may be used while remaining within the scope of the present subject matter.

Figure 5:
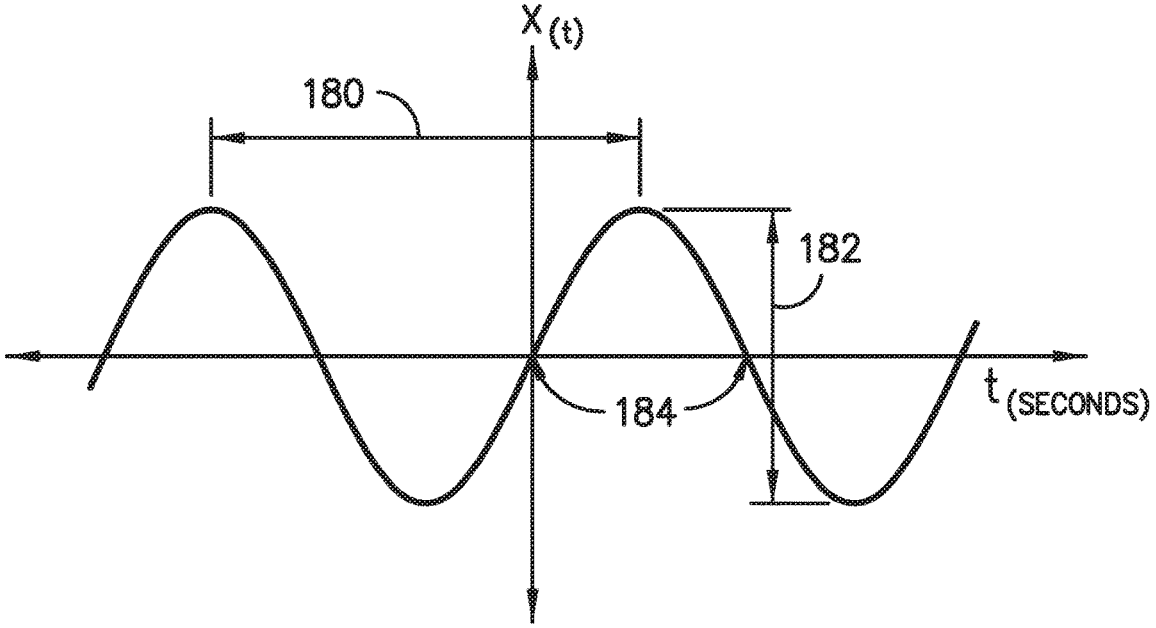
FIG. 5 provides a plot of a movement of the exemplary damper of FIG. 4 during operation of the exemplary washing machine appliance according to an exemplary embodiment of the present subject matter.

Referring now to FIG. 5, a plot of a movement of the exemplary damper 144 of FIG. 4 during operation of the exemplary washing machine appliance 50 is illustrated. More specifically, the plot illustrates the displacement of damper 144 along the X-direction (X(t), measured along the vertical axis) over time (t, measured along the horizontal axis). In this regard, for example, all vertical motion due to sub-washer unit 65 wobble results in motion of damper 144 or cylinder 166. As illustrated, the displacement of damper 144 generally follows a sinusoidal profile as wash basket 70 rotates about axis of rotation 118. A frequency (indicated by reference numeral 180) of damper 144 is illustrated as extending between peaks of the sinusoidal displacement profile. Notably, as illustrated, wash basket 70 rotates at a fixed speed, the frequency 180 being roughly proportional to the speed of the motor assembly 128.

In addition, a stroke length (indicated by reference numeral 182) of the sinusoidal profile is measured along the X-direction between a peak and an adjacent trough, e.g., twice the amplitude of the stroke from an equilibrium position (indicated by reference numeral 184). By using measurement device 148 to obtain the movement of damper 144 as illustrated in FIG. 5, a controller such as controller 150 can calculate the amount of energy dissipated by the dampers 144 and place control limits on the operation of washing machine appliance 50, as described below according to exemplary embodiments.

For example, the amount of energy dissipated in a damper is a function of the normal force, the displacement, and the speed or frequency of the damper movement. In this regard, higher frequencies 180 and higher stroke lengths 182 result in higher energy dissipation, while lower frequencies 180 and lower stroke lengths 182 result in lower energy dissipation. For example, according to exemplary embodiments of the present subject matter, the dissipation of energy in damper 144 may be characterized as the total force exerted on damper 144 times the velocity of damper 144 (i.e., the derivative of the displacement illustrated in FIG. 5).

The total force exerted on damper 144 may be a function of a damper force, e.g., the force used to drive damper 144 and sub-washer unit 65 to the equilibrium position 184. In this regard, for example, the force the damper 144 exerts is the product of a damping coefficient and the velocity. The damping coefficient will be a function of the normal force exerted on inner surface 174 of cylinder 166, materials, temperature, surface condition, etc. A frictional force generated between piston assembly 170 and inner surface 174 of cylinder 166, as well as hydraulic damping may contribute to the total force exerted on damper 144. For example, when sub-washer unit 65 moves down, spring 172 compresses and the damper friction opposes further compression. By contrast, when sub-washer unit 65 moves up, spring 172 extends and the damper friction opposes further extension. These values may be used by controller 150 in determining the amount of energy dissipated by each damper 144.

Figure 6:
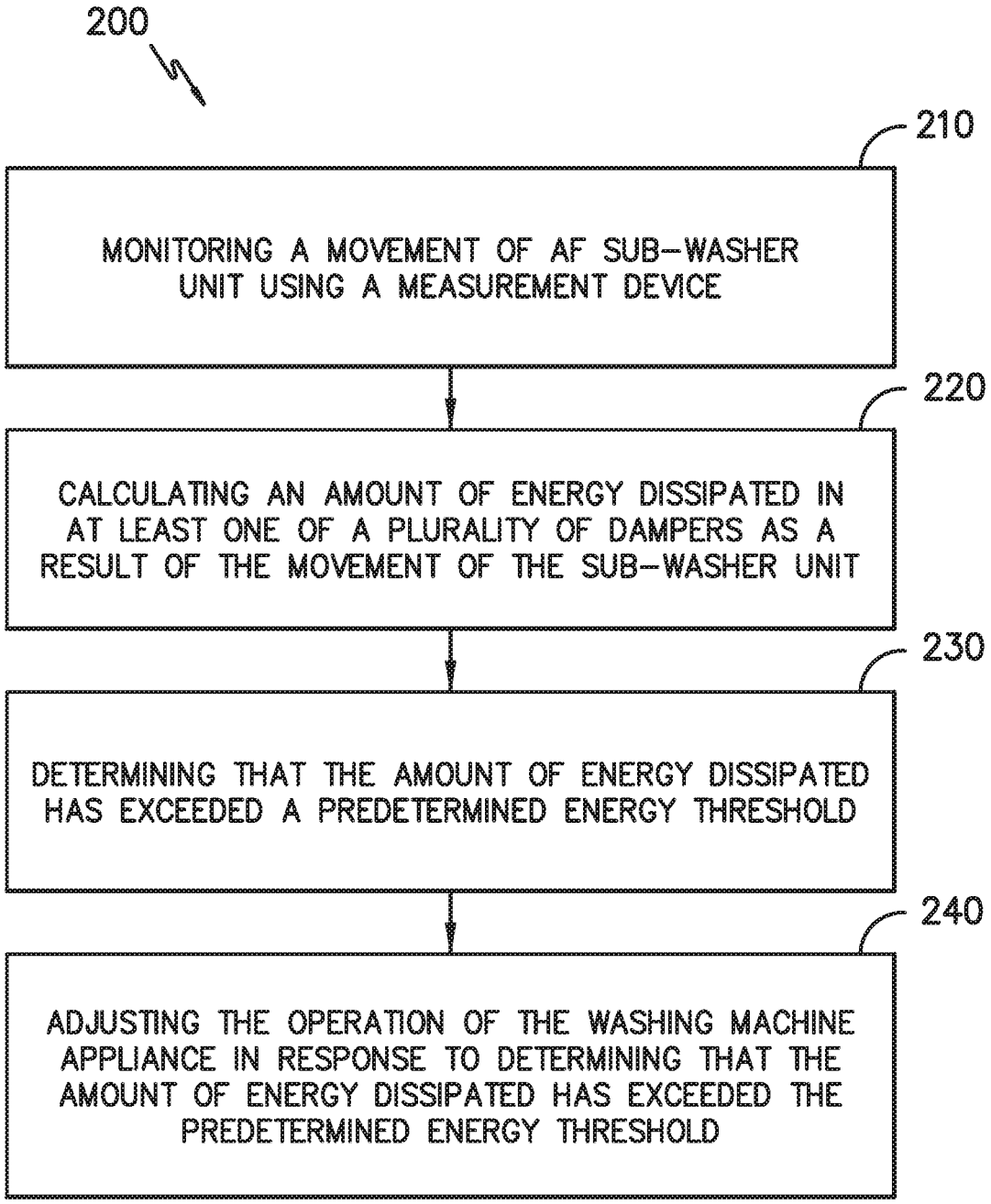
FIG. 6 is a method of operating a washing machine appliance according to an exemplary embodiment of the present subject matter.

Referring now to FIG. 6, various methods may be provided for use with washing machine appliances 50 (FIG. 2) in accordance with the present disclosure. In general, the various steps of methods as disclosed herein may, in example embodiments, be performed by the controller 150 (FIG. 2), which may receive inputs and transmit outputs from various other components of the appliance 50. In particular, the present disclosure is further directed to methods, as indicated by reference number 200, for operating washing machine appliances 50. Such methods advantageously facilitate monitoring of the movement of the sub-washer unit and the displacements of one or more dampers of the suspension system. In this manner, excessive cyclic stresses and heating of the dampers during operation may be avoided.

A method 200 may, for example, include the step 210 of monitoring a movement and a rotational speed of the sub-washer unit using the measurement device. In some embodiments, step 210 includes using an accelerometer attached to the sub-washer unit to measure the acceleration and rotation at a single location on the sub-washer unit, as described above. According to exemplary embodiments, monitoring the movement of the sub-washer unit comprises calculating a displacement of the sub-washer unit proximate the at least one damper using the movement measured by the measurement device and the relative location of the measurement device to the damper. More specifically, the measurement device measures the movement of the sub-washer unit at a first location and trigonometry is used to calculate the displacement of the damper (e.g., as illustrated in FIG. 5). In this manner, a single measurement device can be used to calculate the movement of each damper and ensure none of the dampers are exposed to excess heat.

However, it should be appreciated that other methods of monitoring the motion of the sub-washer unit are contemplated and within the scope of the present subject matter. For example, other measurement methods may include measuring the back electromagnetic force (EMF) through an inverter and using that value to calculate motion (as opposed to using a dedicated measurement device). In such an embodiment, the measurement device may simply be the drive motor of the washing machine appliance.

Method 200 may further include, for example, the step 220 of calculating an amount of energy dissipated in at least one of the plurality of dampers as a result of the movement of the sub-washer unit. For example, according to exemplary embodiments, calculating the amount of energy dissipated in a damper comprises obtaining a measurement of or using a predetermined value for force and multiplying the force by a derivative of the displacement of the sub-washer unit proximate the damper. The amount of energy dissipated may be either a rate of energy dissipation or a cumulative amount of energy dissipation over an operating cycle of the washing machine appliance.

Method 200 may further include, at step 230, determining that the amount of energy dissipated has exceeded a predetermined energy threshold. The predetermined energy threshold may be determined by the controller, entered by the manufacturer, or determined based on a temperature of the dampers during operation. For example, the manufacturer or user may set the predetermined energy threshold based on recommendations or ratings provided by the manufacturer of the damper, such that fatigue and/or failure of the dampers will not occur.

Method 200 may further include, at step 240, adjusting the operation of the washing machine appliance in response to determining that the amount of energy dissipated has exceeded the predetermined energy threshold. For example, adjusting the operation of the washing machine appliance may include adjusting a rotational speed of the wash basket during spin according to an exemplary embodiment. In this regard, by operating the motor assembly to slow down the rotational speed of the wash basket, the frequency of wobble, and thus the velocity of the dampers will be decreased.

In addition, or alternatively, adjusting the operation of the washing machine appliance may include taking measures to redistribute the load of clothing articles such that the load imbalances and resulting wobble during spin cycles are reduced or eliminated. For example, the motor assembly may be operated to redistribute the load of clothes within the wash basket or a user can manually redistribute the clothes. In this manner, the magnitude of displacement may be reduced, resulting in less cyclic stress and heat build-up. In addition, according to another embodiment, a cool down pause in spin may be another option to mitigate overheating.

According to exemplary embodiments, the controller may be configured to provide a user of the washing machine appliance 50 with an indication that the amount of energy dissipated has exceeded the predetermined threshold. For instance, controller 150 may transmit a warning signal to control panel 58 and/or display 61, e.g., via one or more wired connections or busses. At the user interface an audio and/or visual alert signal may be generated. Additionally or alternatively, the warning signal may be transmitted to a secondary device, such as a remote computer, tablet, or smart phone (not pictured), (e.g., via one or more wireless connection protocol). When this indication or warning signal is received, the user may manually redistribute the load and restart the wash cycle. In further embodiments, if excessive wobble is detected (e.g., resulting in the amount of energy dissipated exceeding the predetermined threshold), the rotation of the basket 70 may be halted until corrective action is taken.

As described above, measurement device 148 and method 200 are used to determine the displacement of one or more dampers 144, and the amount of energy dissipated by those dampers 144 is calculated. Limits are placed on the energy dissipation to ensure safe and reliable operation of suspension system 140. However, it should be appreciated that aspects of the present subject matter may be used to control or limit cyclic stresses placed on any structure or component of washing machine appliance 50. In this regard for example, by measuring the movement of sub-washer unit 65 using measurement device 148, the movement of any other remote location on sub-washer unit 65 may be determined and stresses resulting from that movement may be calculated. Similar cyclic stress thresholds may be applied to limit the amount of stress experience by that remote structure or component. Other beneficial applications of the present disclosure will be apparent to those of skill in the art.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

an apron defining a vertical direction, a lateral direction, and a transverse direction, the vertical, lateral, and transverse directions being mutually orthogonal;

a sub-washer unit positioned within the apron, the sub-washer unit comprising a wash basket defining a wash chamber for receipt of articles for washing and being rotatable about an axis of rotation;

a motor assembly operably coupled with the wash basket for rotating the wash basket;

a suspension system comprising a plurality of dampers extending between the apron and the sub-washer unit for suspending the sub-washer unit within the apron;

a measurement device mounted to the sub-washer unit at a first location; and a controller in operative communication with the motor assembly and the measurement device, the controller being configured for:

initiating an operation of the washing machine appliance;

monitoring a movement of the sub-washer unit at the first location using the measurement device, wherein the monitoring comprises calculating a displacement of the sub-washer unit proximate each of the plurality of dampers based on 1) the movement of the sub-washer unit at the first location, and 2) a relative location of each of the plurality of dampers to the first location;

calculating an amount of energy dissipated in each of the plurality of dampers based on the displacement of the sub-washer unit;

determining that the amount of energy dissipated in one of the plurality of the dampers has exceeded a predetermined energy threshold; and adjusting the operation of the washing machine appliance in response to determining that the amount of energy dissipated in one of the plurality of the dampers has exceeded the predetermined energy threshold.

2. The washing machine appliance of claim 1, wherein the measurement device comprises an accelerometer, and wherein monitoring the movement of the sub-washer unit comprises measuring an acceleration of the sub-washer unit along the vertical direction, the lateral direction, and the transverse direction.

3. The washing machine appliance of claim 1, wherein the measurement device comprises a gyroscope, and wherein monitoring the movement of the sub-washer unit comprises measuring a rotation of the sub-washer unit about the vertical direction, the lateral direction, and the transverse direction.

4. The washing machine appliance of claim 1, wherein calculating the amount of energy dissipated in each of the plurality of dampers comprises obtaining a measurement of force applied on each damper and multiplying the measured force by a derivative of the displacement of the sub-washer unit proximate each damper.

5. The washing machine appliance of claim 1, wherein the amount of energy dissipated is either a rate of energy dissipation or a cumulative amount of energy dissipation over an operating cycle of the washing machine appliance.

6. The washing machine appliance of claim 1, wherein the measurement device is positioned on the sub-washer unit away from the axis of rotation.

7. The washing machine appliance of claim 1, wherein adjusting the operation of the washing machine appliance comprises adjusting a rotational speed of the wash basket.

8. The washing machine appliance of claim 1, wherein the suspension system comprises four dampers, each of the four dampers extending from a top of the apron to a bottom of the sub-washer unit along the vertical direction.

9. The washing machine appliance of claim 1, wherein each of the plurality of dampers comprises a rod and spring assembly that utilizes hydraulic and frictional damping.

10. The washing machine appliance of claim 1, wherein the controller is further configured to provide a user of the washing machine appliance with an indication that the amount of energy dissipated has exceeded the predetermined energy threshold.

11. The washing machine appliance of claim 1, wherein the washing machine appliance is a vertical axis washing machine, such that the axis of rotation is parallel to the vertical direction.

* * * * *